US012029330B2

(12) United States Patent
Saint et al.

(10) Patent No.: US 12,029,330 B2
(45) Date of Patent: Jul. 9, 2024

(54) INFANT PLAYPEN AND AN ENCLOSURE FOR THE INFANT PLAYPEN

(71) Applicant: Wonderland Switzerland AG, Steinhausen (CH)

(72) Inventors: Nathanael Saint, Morgantown, PA (US); Jennifer E. Sheldrick, Malvern, PA (US); Linda L. Forester, Pottstown, PA (US)

(73) Assignee: Wonderland Switzerland AG, Steinhausen (CH)

( * ) Notice: Subject to any disclaimer, the term of this patent is extended or adjusted under 35 U.S.C. 154(b) by 216 days.

(21) Appl. No.: 17/587,278

(22) Filed: Jan. 28, 2022

(65) Prior Publication Data

US 2022/0151399 A1 May 19, 2022

Related U.S. Application Data

(63) Continuation of application No. 16/271,352, filed on Feb. 8, 2019, now Pat. No. 11,272,792.

(60) Provisional application No. 62/629,281, filed on Feb. 12, 2018.

(51) Int. Cl.

| | |
|---|---|
| ***A47D 13/06*** | (2006.01) |
| ***A47D 7/00*** | (2006.01) |
| ***A47D 11/00*** | (2006.01) |
| ***A47D 13/00*** | (2006.01) |

(52) U.S. Cl.

CPC ..... *A47D 13/063* (2013.01); *A47D 7/002* (2013.01); *A47D 11/007* (2013.01); *A47D 13/00* (2013.01); *A47D 13/066* (2013.01)

(58) Field of Classification Search

CPC .... A47D 13/063; A47D 7/002; A47D 11/007; A47D 13/00; A47D 13/066; A47D 13/061; A47D 9/016; A47D 13/06; E04H 15/02; E04H 15/34; E04H 15/54; E04H 15/64; Y10T 428/24686

USPC ..... 5/98, 93.1, 98.1, 99.1; 112/427; 256/25

See application file for complete search history.

(56) References Cited

U.S. PATENT DOCUMENTS

| | | | | |
|---|---|---|---|---|
| 2,947,993 | A * | 8/1960 | Donath | D06J 1/12 112/427 |
| 4,376,318 | A * | 3/1983 | Cirillo | A47D 13/063 5/99.1 |
| 5,727,265 | A * | 3/1998 | Ziegler | A47D 13/063 5/99.1 |
| 9,149,128 | B2 * | 10/2015 | Rampton | A47D 13/063 |
| 9,326,902 | B2 * | 5/2016 | Swanson | A47D 13/063 |
| 9,848,714 | B2 * | 12/2017 | Burns | A47D 13/06 |
| 10,463,170 | B2 * | 11/2019 | Lange | A47D 13/063 |
| 2012/0248394 | A1 * | 10/2012 | Thorne | A47D 13/061 256/25 |

* cited by examiner

*Primary Examiner* — Justin C Mikowski
*Assistant Examiner* — Madison Emanski
(74) *Attorney, Agent, or Firm* — NZ CARR LAW OFFICE

(57) ABSTRACT

An enclosure for an infant playpen includes a flexible material installable on a support frame of the infant playpen, the flexible material including at least one pleat comprised of two folds that are folded toward each other over a base region of the flexible material and respectively have two folded edge portions adjacent to each other, each of the two folded edge portions having at least one end affixed to the flexible material. Moreover, some embodiments provide an infant playpen that includes a support frame and the enclosure installed thereon.

15 Claims, 8 Drawing Sheets

INFANT PLAYPEN AND AN ENCLOSURE FOR THE INFANT PLAYPEN

CROSS-REFERENCE TO RELATED APPLICATION(S)

This application is a continuation application of U.S. patent application Ser. No. 16/271,352 filed on Feb. 8, 2019, which claims priority to U.S. provisional application No. 62/629,281 filed on Feb. 12, 2018, the disclosure of which is hereby incorporated by reference.

BACKGROUND

1. Field of the Invention

The present invention relates to infant playpens.

2. Description of the Related Art

An infant playpen can typically receive a child in a safe and comfortable environment. Many existing infant playpens are designed with a frame structure that allows folding into a compact form for convenient transport or storage. However, the conventional folding structures may be complex, which makes it difficult for a caregiver to fold and unfold the infant playpens. In particular, folding and unfolding infant playpens can be difficult for caregivers who are physically inhibited in a way that reduces their strength and coordination.

Another common problem with current infant playpens includes the difficulty in removing the flexible enclosure from the frame structure. A child occupant of the infant playpen may have a tendency to produce stains on the enclosure. When the enclosure is difficult to remove, a caregiver may not be able to easily wash the stains away.

Therefore, there is a need for an improved design that can provide an infant playpen that is more convenient in use, and can address at least the foregoing issues.

SUMMARY

The present application describes an infant playpen that can be folded and unfolded effortlessly and has a construction allowing easy removal of an enclosure from a support frame.

Moreover, the present application describes an enclosure that is installable on a support frame of an infant playpen.

According to one aspect, an enclosure for an infant playpen includes a flexible material installable on a support frame of the infant playpen, the flexible material including at least one pleat comprised of two folds that are folded toward each other over a base region of the flexible material and respectively have two folded edge portions adjacent to each other, each of the two folded edge portions having at least one end affixed to the flexible material.

According to another aspect, the present application describes an infant playpen that includes a support frame and the aforementioned enclosure, wherein the two folded edge portions are adjacent to each other when the support frame having the enclosure installed thereon is in an unfolded state, and the two folded edge portions are stretched away from each other so that more of the base region is exposed when the support frame having the enclosure installed thereon is in a folded state.

DETAILED DESCRIPTION OF THE EMBODIMENTS

Figure 1:
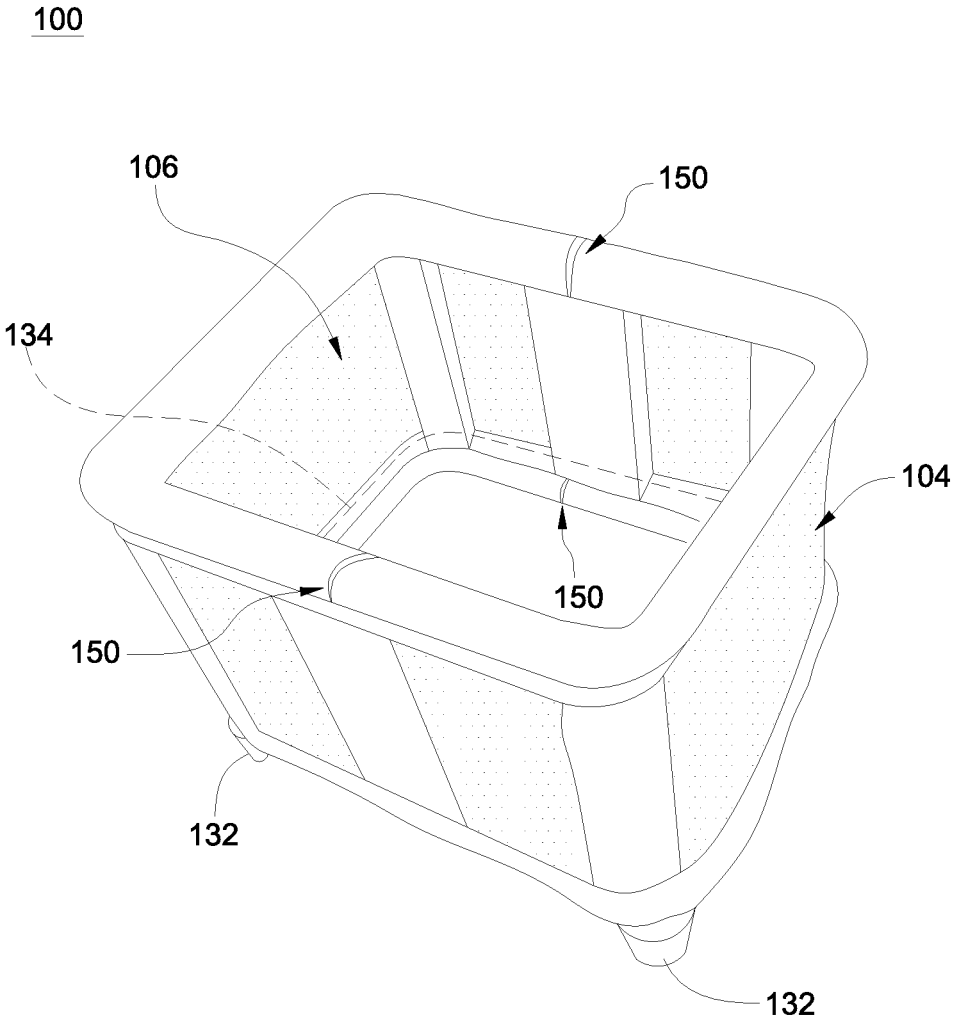
FIG. 1 is a perspective view illustrating an embodiment of an infant playpen in an unfolded state.
Figure 2:
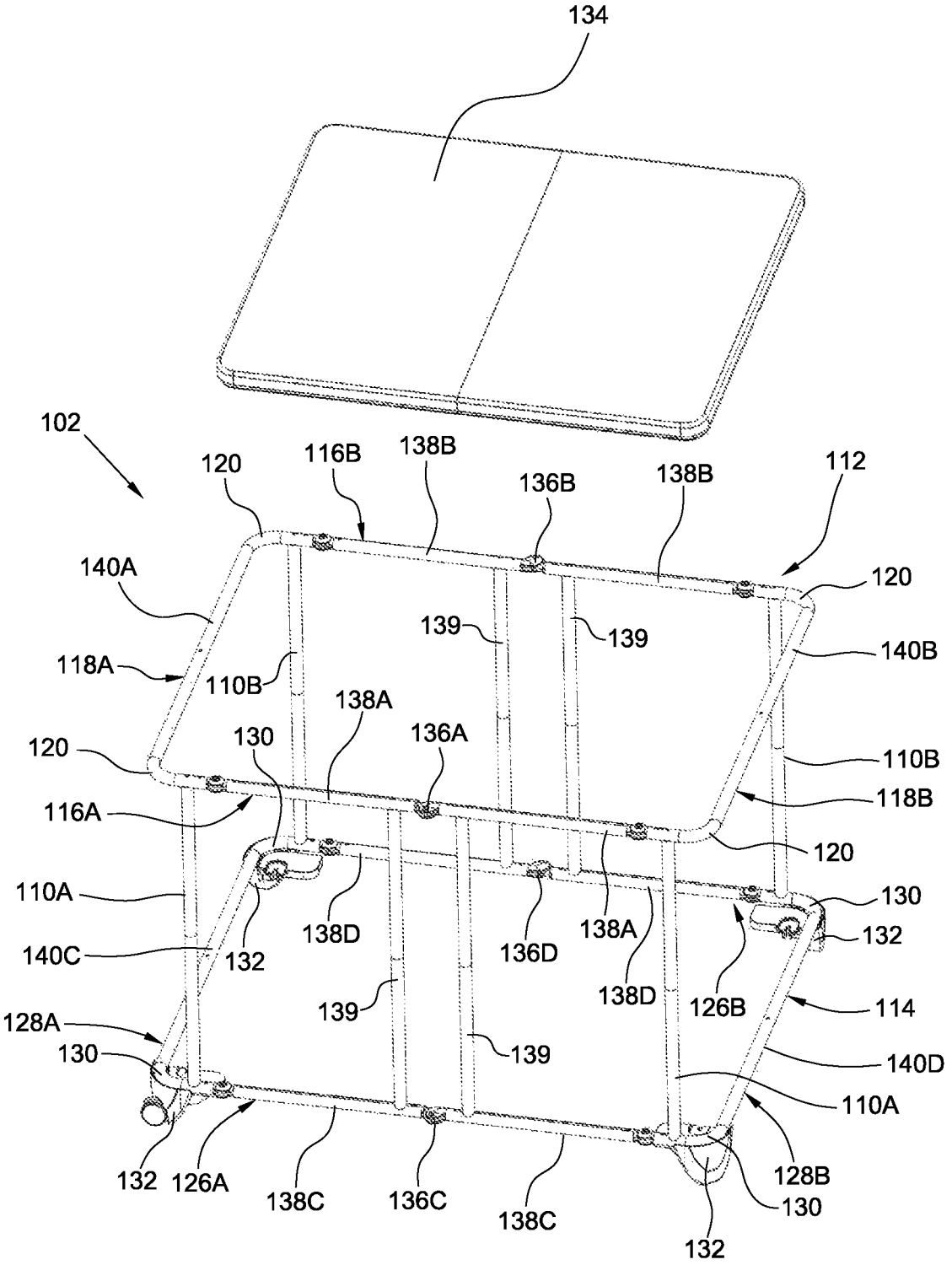
FIG. 2 is a perspective view illustrating a rigid support frame of the infant playpen.
Figure 3:
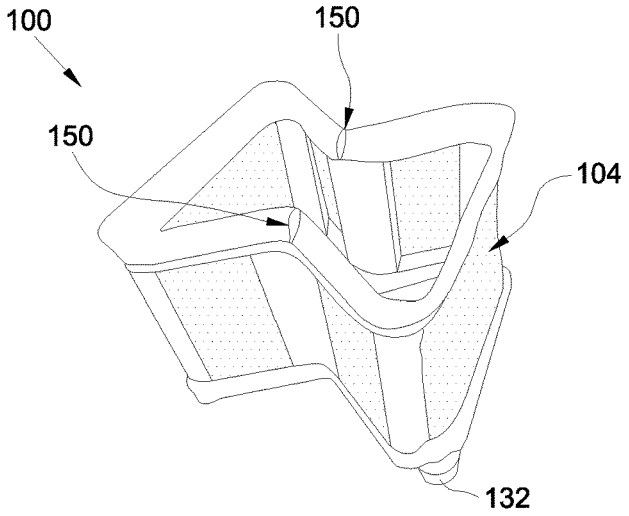
FIGS. 3-5 are perspective views illustrating exemplary folding of the infant playpen shown in FIG. 1.
Figure 4:
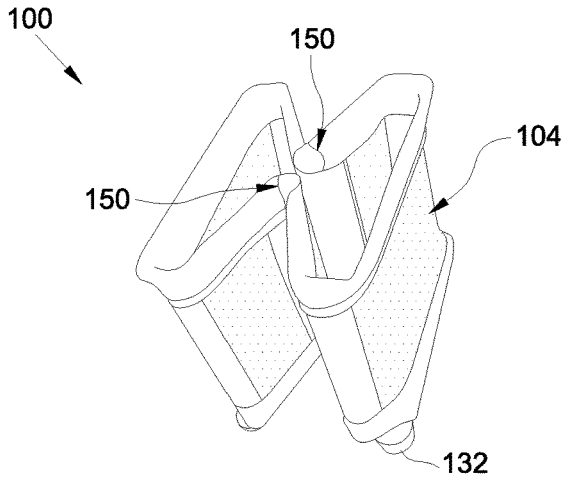
Figure 5:
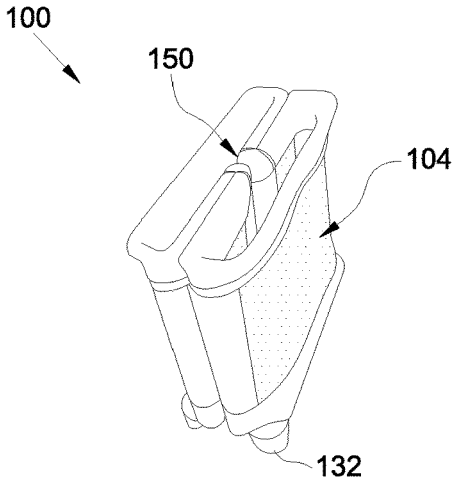

FIG. 1 is a perspective view illustrating an embodiment of an infant playpen 100 in an unfolded state, and FIG. 2 is a perspective view illustrating a rigid support frame 102 of the infant playpen 100. Referring to FIGS. 1 and 2, the infant playpen 100 can include a rigid support frame 102 formed by the assembly of multiple tube segments, and an enclosure 104 that can be installed on the support frame 102 and surround an interior 106 of the infant playpen 100. The support frame 102 can include a plurality of upright legs 110A and 110B, a top frame portion 112 and a bottom frame portion 114.

According to an example of construction, the top frame portion 112 may include two side rail assemblies 116A and 116B opposite to each other and extending substantially parallel to each other along a first direction, and two other side rail assemblies 118A and 118B opposite to each other and extending substantially parallel to each other along a second direction perpendicular to the first direction. The side rail assemblies 118A and 118B can be respectively connected with the side rail assemblies 116A and 116B via a plurality of top corner parts 120.

The bottom frame portion 114 is disposed below the top frame portion 112. According to an example of construction, the bottom frame portion 114 may include two side rail assemblies 126A and 126B opposite to each other and extending substantially parallel to each other along the first direction, and two other side rail assemblies 128A and 128B opposite to each other and extending substantially parallel to each other along the second direction perpendicular to the first direction. In particular, the two side rail assemblies 126A and 126B of the bottom frame portion 114 can be substantially parallel to the two side rail assemblies 116A and 116B of the top frame portion 112, respectively. The two side rail assemblies 128A and 128B of the bottom frame portion 114 can be substantially parallel to the two side rail assemblies 118A and 118B of the top frame portion 112, respectively. Moreover, the side rail assemblies 128A and 128B can be respectively connected with the side rail assemblies 126A and 126B via a plurality of bottom corner parts 130.

The four upright legs 110A and 110B can provide support for the top frame portion 112. For example, each of the upright legs 110A and 110B may be formed by an upright tubular segment that an upper end affixed with one top corner joint 120 and a lower end affixed with one bottom corner part 130. According to an example of construction, each bottom corner part 130 can be fixedly connected with a foot portion 132 protruding downward. The foot portions 132 can provide stable standing support for the infant playpen 100 on a floor surface.

Referring to FIGS. 1 and 2, a mattress 134 (shown with phantom lines in FIG. 1) may be disposed at a bottom of the infant playpen 100. According to an example of construction, the mattress 134 may be peripherally supported by the bottom frame portion 114 of the support frame 102 without the need of having a bottom panel under the mattress 134. For example, multiple brackets may be respectively provided at the corners of the bottom frame portion 114 for supporting the mattress 134. This may allow simple assembly and disassembly of the infant playpen 100, and reduce the manufacturing cost. The mattress 134 may be removed when the infant playpen 100 is to be folded.

Referring to FIG. 2, the support frame 102 can include a plurality of pivot connections for folding and unfolding of the infant playpen 100. For example, a middle of the side rail assembly 116A can have a pivot connection 136A that couples two bars 138A of the side rail assembly 116A. A middle of the side rail assembly 116B can have a pivot connection 136B that couples two bars 138B of the side rail assembly 116B. A middle of the side rail assembly 126A can have a pivot connection 136C that couples two bars 138C of the side rail assembly 126A. A middle of the side rail assembly 126B can have a pivot connection 136D that couples two bars 138D of the side rail assembly 126B. Moreover, each of the bars 138A and 138B can be respectively connected pivotally with one top corner part 120, and each of the bars 138C and 138D can be respectively connected pivotally with one bottom corner part 130. A plurality of upright bars 139 may be respectively connected between the side rail assemblies 116A and 126A and between the side rail assemblies 116B and 126B for providing further support stability.

Referring to FIG. 2, the side rail assembly 118A of the top frame portion 112 can include a continuous bar 140A having no middle pivot connection, and the side rail assembly 118B of the top frame portion 112 can have a continuous bar 140B having no middle pivot connection. Each of the bars 140A and 140B can be respectively connected fixedly with two top corner parts 120 at two opposite ends. Likewise, the side rail assembly 128A of the bottom frame portion 114 can include a continuous bar 140C having no middle pivot connection, and the side rail assembly 128B of the bottom frame portion 114 can have a continuous bar 140D having no middle pivot connection. Each of the bars 140C and 140D can be respectively connected fixedly with two bottom corner parts 130 at two opposite ends.

In conjunction with FIGS. 1 and 2, FIGS. 3-5 are perspective views illustrating exemplary folding of the infant playpen 100. Referring to FIGS. 1-5, the infant playpen 100 can be collapsed by folding the two side rail assemblies 116A and 116B of the top frame portion 112 about the pivot connections 136A and 136B and by folding the two side rail assemblies 126A and 126B of the bottom frame portion 114 about the pivot connections 136C and 136D, whereby the side rail assemblies 118A and 128A can respectively move toward the side rail assemblies 118B and 128B.

Referring to FIG. 1-5, the enclosure 104 can be made of a flexible material. Examples of suitable materials for the enclosure 104 can include, without limitation, fabrics, mesh materials and like soft goods. The enclosure 104 may be installed on the support frame 102 so as to surround the interior 106 of the infant playpen 100 where a child can be received. Once the enclosure 104 is installed on the support frame 102, the enclosure 104 can wrap around the top frame portion 112 and stretch downward to the bottom frame portion 114. For facilitating folding of the infant playpen 100, the enclosure 104 can include a plurality of expandable portions 150. When the enclosure 104 is installed on the support frame 102, the expandable portions 150 can respectively cover the pivot connections 136A, 136B, 136C and 136D.

Figure 6:
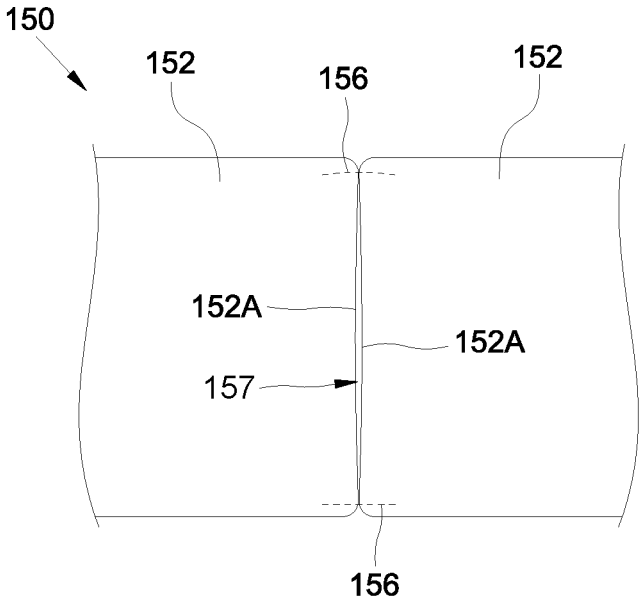
FIG. 6 is an enlarged planar view of a expandable portion provided on an enclosure of the infant playpen.
Figure 7:
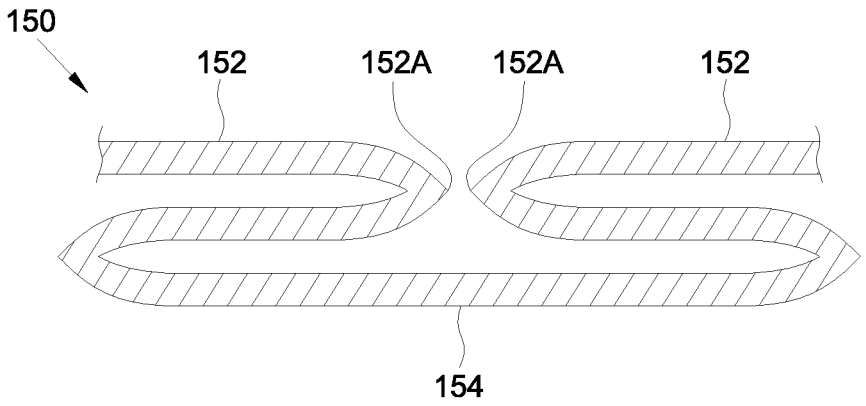
FIG. 7 is a cross-sectional view of the expandable portion.

All the expandable portions 150 of the enclosure 104 can have a similar structure. In conjunction with FIGS. 1-5, FIG. 6 is an enlarged planar view of one expandable portion 150, and FIG. 7 is a cross-sectional view of the expandable portion 150. Referring to FIGS. 6 and 7, the expandable portion 150 can be made of a flexible material, and can include multiple folds 152. Example of suitable materials for the expandable portion 150 may include, without limitation, fabrics. When the enclosure 104 is installed on the support frame 102, the folds 152 can wrap around the pivot connection (i.e., any one of the pivot connections 136A, 136B, 136C and 136D) that is covered by the expandable portion 150. According to an example of construction, the expandable portion 150 may include two folds 152 respectively having two folded edge portions 152A that are movable toward and away from each other for contraction and expansion of the expandable portion 150.

Figure 8:
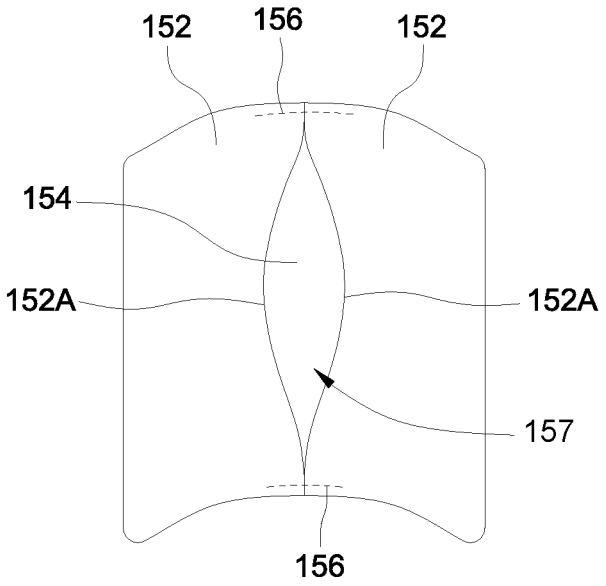
FIG. 8 is a schematic view illustrating the expandable portion in an expanded state.

According to an embodiment, the expandable portion 150 may include an inverted box pleat. The inverted box pleat may be formed by having the two folds 152 folded toward one another over a base region 154 of the enclosure fabric so that the two folded edge portions 152A of the two folds 152 are substantially adjacent to each other. Two sewing lines 156 then may be respectively applied at two opposite ends of each folded edge portion 152A to hold the inverted box pleat. The two folded edge portions 152A and the two sewing lines 156 can thereby define an opening 157 that contracts when the expandable portion 150 is unfolded, as illustrated in FIG. 6. When the expandable portion 150 is folded, the opening 157 can enlarge, as illustrated in FIG. 8.

Figure 9:
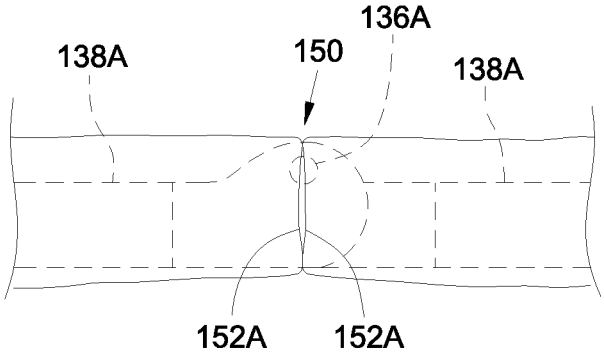
FIG. 9 is an enlarged view illustrating the expandable portion of the enclosure associated with one pivot connection of the infant playpen in an unfolded state.
Figure 10:
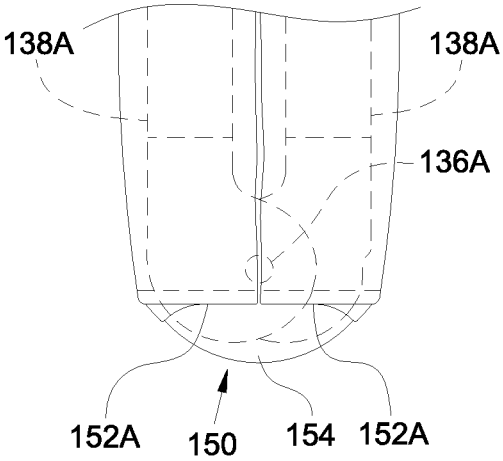
FIG. 10 is an enlarged view illustrating the expandable portion when the infant playpen is in a folded state.

In conjunction with FIGS. 1 and 2, FIG. 9 is an enlarged view illustrating the expandable portion 150 of the enclosure 104 associated with the pivot connection 136A of the infant playpen 100 in an unfolded state, and FIG. 10 is an enlarged view illustrating the expandable portion 150 when the infant playpen 100 is in a folded state. Referring to FIG. 9, when the pivot connection 136A is in the unfolded state with the two bars 138A extending generally along a same line, the expandable portion 150 of the enclosure 104 can appear relatively flat with the two folded edge portions 152A adjacent to each other. Referring to FIG. 10, when the pivot connection 136A is in the fully folded state with the two bars 138A adjacent and parallel to each other, the two folded edge portions 152A stretch away from each other so that the base region 154 is exposed. It will be readily appreciated that the expandable portions 150 associated with the other pivot connections 136B, 136C and 136D can be configured and operate in a similar way.

The expandable portions 150 of the enclosure 104 described herein do not affect the overall outer appearance when the infant playpen 100 is unfolded for use, and allow full folding of the infant playpen 100 without requiring the user to exert much effort or precise coordination. Moreover, when the infant playpen 100 is fully folded, the enclosure 104 can substantially enclose the pivot connections 136A and 136B so that a child would not be able to directly touch or hit the rigid structure of the pivot connections, which may prevent undesirable accidents. This can provide a significant improvement over conventional infant playpens that usually do not enclose the pivot connections with the enclosure fabric so as not to impede the ability of the infant playpens to fold into a small size.

In conjunction with FIGS. 1 and 2, FIGS. 11 and 12 are two perspective views illustrating a further construction feature that may be applied in the infant playpen 100. Referring to FIGS. 1, 2, 11 and 12, the enclosure 104 may include an inner layer 160 and an outer layer 162 connected with each other. The inner layer 160 and the outer layer 162 can delimit a hollow interior of the enclosure 104 in which the four upright legs 110A and 110B, the top frame portion 112 and the bottom frame portion 114 can be received. Examples of flexible materials for the inner layer 160 and the outer layer 162 can include, without limitations, fabrics, mesh materials and like soft goods. When the enclosure 104 is installed on the support frame 102, the support frame 102 can extend through the hollow interior between the inner layer 160 and the outer layer 162, whereby the inner layer 160 and the outer layer 162 can substantially enclose the four upright legs 110A and 110B, the top frame portion 112 and the bottom frame portion 114. Once the enclosure 104 is installed, the inner layer 160 faces the interior 106 of the infant playpen 100, the outer layer 162 faces outward, and the foot portions 132 can protrude outward from corresponding foot holes provided in the enclosure 104. Each of the sidewalls of the enclosure 104 stretching between the upright legs 110A and 110B can thus include the inner layer 160 and the outer layer 162. With this dual-layer sidewall structure, the enclosure 104 may be more durable. Moreover, the inner layer 160 and the outer layer 162 may have different design patterns and/or colors as desired.

Figure 11:
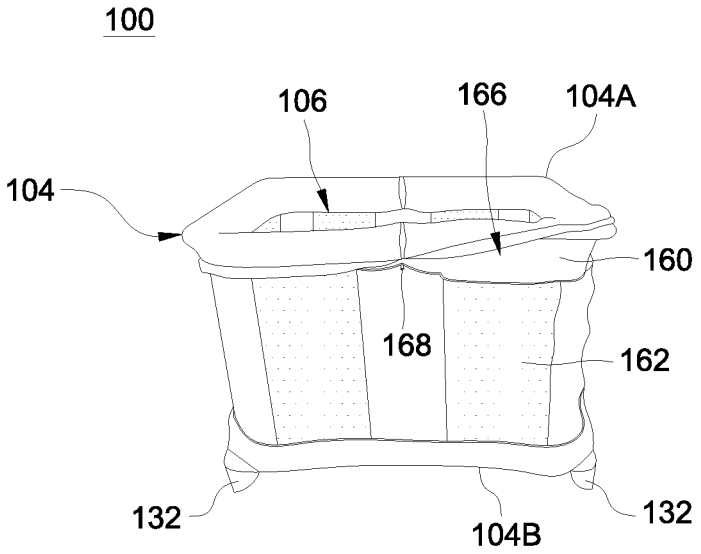
FIGS. 11 and 12 are two perspective views illustrating a further construction feature that may be applied in an infant playpen.
Figure 12:
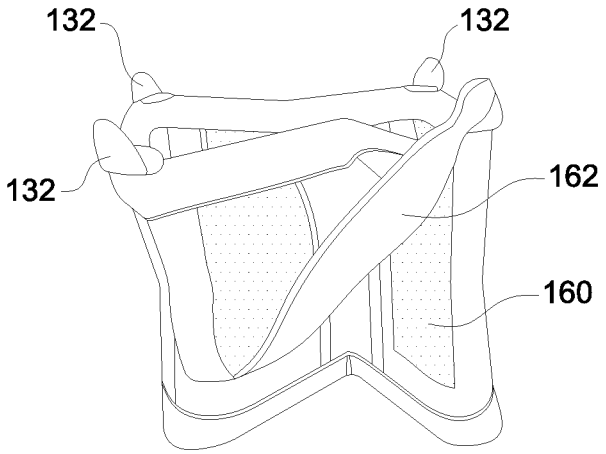

Referring to FIGS. 11 and 12, the enclosure 104 can include an opening 166 communicating with the hollow interior between the inner layer 160 and the outer layer 162. The size of the opening 166 is sufficiently large for installation and removal of the enclosure 104 on the support frame 102. For example, the opening 166 may extend along at least one side of the enclosure 104. According to an embodiment, the opening 166 may extend circumferentially around the enclosure 104. According to an example of construction, the opening 166 may be disposed closer to a top 104A of the enclosure 104 than a bottom 104B of the enclosure 104. It will be appreciated, however, that other positions of the opening 166 may be possible. Moreover, the enclosure 104 can include a fastener 168 operable to open and close the opening 166. According to an example of construction, the fastener 168 may be a zip fastener.

The aforementioned construction may allow easy installation and removal of the enclosure 104. A caregiver can operate the fastener 168 to open the enclosure 104, as illustrated in FIG. 11. Then the infant playpen 100 may be flipped so that the foot portions 132 are on top, and the outer layer 162 may be lifted for removing the enclosure 104 from the support frame 102, as illustrated in FIG. 12. Once the enclosure 104 is removed from the support frame 102, the inner layer 160 and the outer layer 162 remain connected with each other so that the enclosure 104 is still one single part for convenient storage or washing.

It will be appreciated that the features and advantages described herein in relation to the dual-layer sidewall structure of the enclosure 104 may be provided for various embodiments of the infant playpen. For example, the features described herein in relation to the dual-layer sidewall structure of the enclosure 104 may be implemented separately or in combination with the expandable portions 150 according to the design requirements.

Advantages of the infant playpen described herein include an enclosure that has expandable portions covering pivot connections so that the infant playpen can be effectively folded and unfolded effortlessly. Moreover, the enclosure may have a dual-layer sidewall structure providing durability and allowing easy installation and removal of the enclosure.

Realization of the infant playpen has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An enclosure for an infant playpen, the enclosure comprising a flexible material installable on a support frame of the infant playpen, the flexible material including at least one pleat comprised of two folds that are folded toward each other over a base region of the flexible material and respectively have two folded edge portions adjacent to each other, each of the two folded edge portions having at least one end affixed to the flexible material.

2. The enclosure according to claim 1, wherein the two folded edge portions respectively have two ends that are affixed to the flexible material adjacent to each other.

3. The enclosure according to claim 2, wherein the pleat includes a sewing line that is applied across the two ends of the two folded edge portions.

4. The enclosure according to claim 1, wherein the pleat is exposed when the enclosure is installed on the support frame of the infant playpen.

5. The enclosure according to claim 1, wherein the two folded edge portions are stretchable away from each other so as to expose more of the base region of the flexible material.

6. The enclosure according to claim 1, wherein the pleat is an inverted box pleat.

7. The enclosure according to claim 1, wherein the enclosure has a sidewall including an inner layer, an outer layer, and a hollow interior between the inner layer and the outer layer, the hollow interior between the inner layer and the outer layer being adapted to receive at least partially the support frame of the infant playpen.

8. The enclosure according to claim 7, wherein the enclosure includes an opening communicating with the hollow interior between the inner layer and the outer layer, the opening extending along at least one side of the enclosure.

9. The enclosure according to claim 8, wherein the enclosure has a top and a bottom, the opening being disposed closer to the top than the bottom.

10. The enclosure according to claim 8, wherein the enclosure includes a fastener operable to open and close the opening.

11. An infant playpen comprising:

a support frame; and an enclosure comprising a flexible material installable on the support frame, the flexible material including at least one pleat comprised of two folds that are folded toward each other over a base region of the flexible material and respectively have two folded edge portions adjacent to each other, each of the two folded edge portions having at least one end affixed to the flexible material, wherein the two folded edge portions are adjacent to each other when the support frame having the enclosure installed thereon is in an unfolded state, and the two folded edge portions are stretched away from each other so that more of the base region is exposed when the support frame having the enclosure installed thereon is in a folded state.

12. The infant playpen according to claim 11, wherein the pleat is located adjacent to a pivot connection of the support frame when the enclosure is installed on the support frame.

13. The infant playpen according to claim 12, wherein the pleat wraps around the pivot connection when the enclosure is installed on the support frame.

14. The infant playpen according to claim 1, wherein the at least one end of each of the two folded edge portions is affixed to the base region of the flexible material.

15. An enclosure for an infant playpen having an unfolded state and a folded state, the enclosure comprising a flexible material installable on a support frame of the infant playpen, the flexible material including at least one pleat comprised of two folds that are folded toward each other over a base region of the flexible material and respectively have two folded edge portions configured to be adjacent to each other when the infant playpen is in the unfolded state, each of the two folded edge portions having at least one end affixed to the flexible material.

* * * * *